US005887459A

United States Patent [19]

Fleissner

[11] Patent Number: 5,887,459

[45] Date of Patent: Mar. 30, 1999

[54] DEVICE FOR APPLYING A LIQUID FILM, UNIFORMLY THIN OVER THE WORKING WIDTH, TO A WEB OF GOODS

[75] Inventor: Gerold Fleissner, Zug, Switzerland

[73] Assignee: Fleissner GmbH & Co., Mashinenfabrik, Egelsbach, Germany

[21] Appl. No.: 677,529

[22] Filed: Jul. 10, 1996

[30] Foreign Application Priority Data

Jul. 14, 1995 [DE] Germany ..... 195 25 458.9

[51] Int. Cl.[6] ..... D06B 1/06

[52] U.S. Cl. ..... 68/205 R; 118/325

[58] Field of Search ..... 68/200, 205 R; 118/324, 325

[56] References Cited

U.S. PATENT DOCUMENTS 3,667,258 6/1972 Newton ..... 68/205 R
3,886,898 6/1975 Colegrove .
4,656,845 4/1987 Fleissner ..... 68/205 R
5,243,841 9/1993 Fleissner ..... 68/205 R
5,737,945 4/1998 Fleissner ..... 68/200

FOREIGN PATENT DOCUMENTS 3808698 9/1989 Germany .

*Primary Examiner*—Philip R. Coe
*Attorney, Agent, or Firm*—Antonelli, Terry, Stout & Kraus, LLP

[57] ABSTRACT

In dye applicators that operate by the pouring principle, it is known to hold back liquid flowing over an overflow weir in a liquid supply chamber located upstream of the weir. To achieve a dye applicator that can be adjusted to a desired working width, this liquid supply chamber is subdivided several times by limiting walls, and a liquid inflow bore is associated with each of the partial liquid supply chambers thus formed. The flanks of the liquid supply chambers delimited by a parallel dam and opposite dam are designed to diverge and to create a plurality of separate liquid supply chambers that expands toward the overflow weir.

14 Claims, 3 Drawing Sheets

DEVICE FOR APPLYING A LIQUID FILM, UNIFORMLY THIN OVER THE WORKING WIDTH, TO A WEB OF GOODS

FIELD OF INVENTION

This invention relates to a device for applying a liquid film of considerable width and exhibiting laminar flow, uniformly thin over a working width, to a continuously advancing web of goods, the device having a liquid supply chamber which is delimited on one side by a first dam, directed diagonally upward at an angle to the horizontal and extending over the working width, said dam having an overflow weir in the flow direction of the liquid, as well as a guiding surface abutting the overflow weir, from the lower edge of which surface, the film of liquid that runs overflows onto the web of goods, and which also is delimited by a second, opposite dam at a distance from the first dam, with the liquid supply chamber having a liquid inflow area at the end opposite the overflow weir, said area being formed by a plurality of liquid inflow openings connected with a plurality of liquid inflow hoses supplied with liquid by a pump; and said device having a plurality of partial liquid supply chambers found within said liquid supply chamber.

BACKGROUND OF THE INVENTION

A device of a type similar to the invention is known from DE 35 22 320 A1 and corresponding U.S. Pat. No. 4,656,845. It is characterized by uniform liquid application to the advancing web of goods.

A dye applicator is generally designed to have a certain working width. In practice, however, advancing textile webs to be dyed vary in width, possibly even within a short time. The machine manufacturer has been given the task of supplying dyeing devices that allow different working widths to be traversed at short intervals. It has been found in practice that the limitation of the working width in the vicinity of the liquid outflow at the guide surface of the dye applicator cannot be accomplished satisfactorily. This is especially true regarding the uniformity of the amount of dye applied in the marginal area of the textile material.

SUMMARY OF THE INVENTION

A goal of the invention is to further improve an applicator of the type recited at the outset in such fashion that it becomes possible, in a simple fashion, to reduce within a short time the maximum working width for which it was designed, or even to increase it later, without the quality of the uniformity of the liquid application suffering as a result.

To achieve the stated goal, provision is made according to the invention such that the liquid supply chamber that extends over the full working width of the entire device in the vicinity of the overflow weir is limited in width by a limiting wall in the space of the liquid supply chamber, said wall extending from the overflow weir to the liquid inflow area. It is particularly advantageous for a plurality of such limiting walls to limit the working width of the liquid supply chamber several times and to define a plurality of partial or sub liquid supply chambers. It is also advantageous for only one of the liquid inflow openings to be associated with each of the partial liquid supply chambers. By controlling the number of inflow openings required for a desired working width, the working width of the applicator can be determined or regulated in the vicinity of the liquid supply chamber, and consequently so can the resultant outflow area of the liquid over the guiding surface, which remains unlimited.

It is also known from DE 35 22 320 A1, heretofore described, to expand the volume of the liquid supply chamber slowly in terms of its cross section toward the outflow weir. For this purpose, the second dam, opposite the first dam, is made approximately 10° steeper. As a result of the liquid supply chamber thus expanding toward the overflow weir, a necessary calming of the liquid inflow stream required to form a laminar liquid film flow up to the overall weir is produced. The increase in volume causes the vortices to blend.

Such a tapered increase in volume is also to be achieved in the device with the limiting walls according to the invention. Provision is therefore made in designing this device for the first dam and the opposite dam to run parallel to one another, and the conicity of each partial liquid supply chamber is then produced by the additional limiting walls that partially fills the liquid supply chamber, the flanks of each of said walls tapering toward the overflow weir from the respective liquid inflow opening. A great deal is achieved with a device of this kind: it is simple to manufacture, it permits exact setting of any desired working width and, owing to the increase in volume of the liquid supply chamber just upstream of the overflow weir, it continues to ensure uniform liquid application over any desired working width.

BRIEF DESCRIPTION OF THE DRAWINGS

The many improved features of the invention will be described in greater detail with reference to the accompanying drawings. The drawings show an embodiment of a device according to the invention wherein.

DETAILED DESCRIPTION OF THE DRAWINGS

Figure 1:
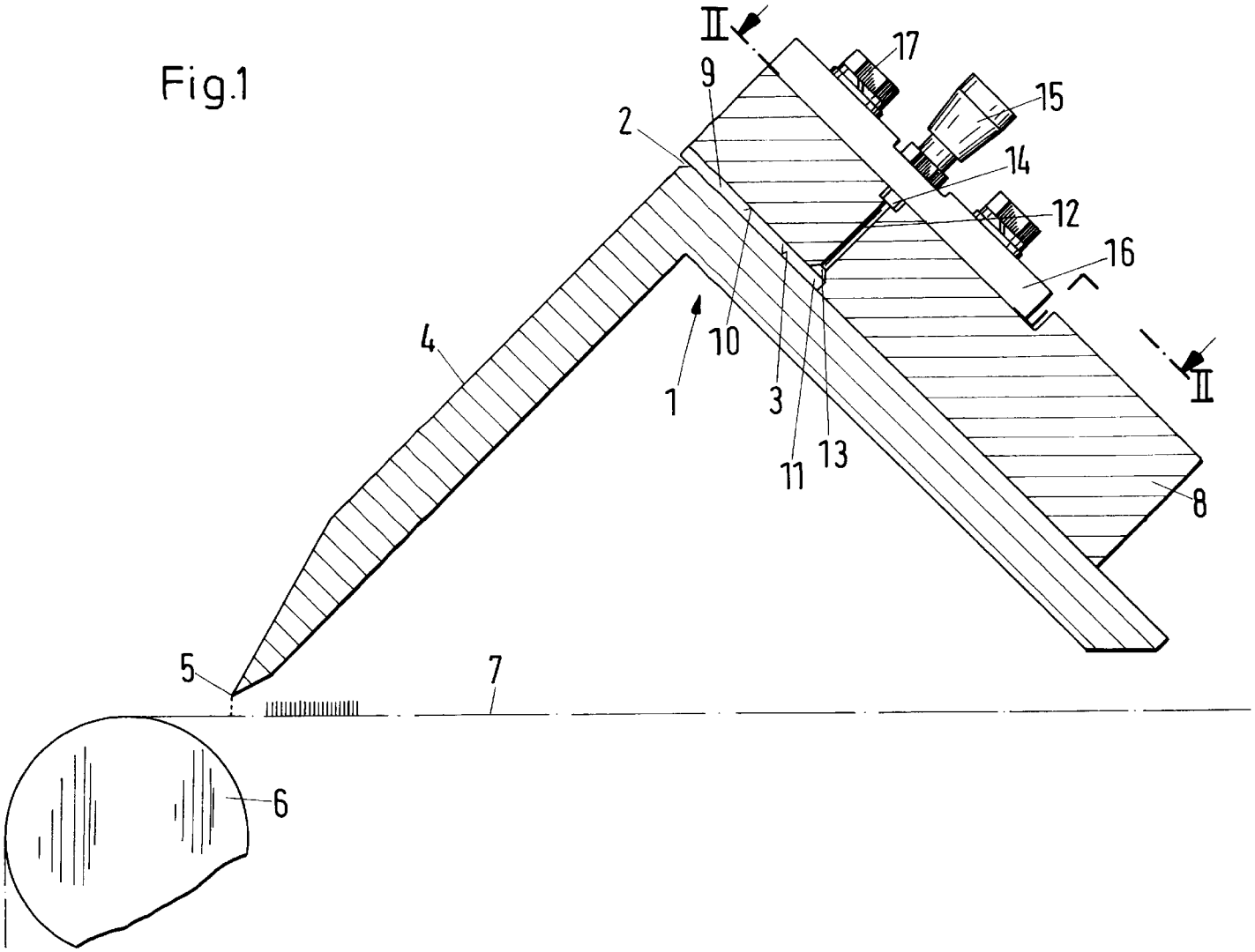
FIG. 1 is a cross sectional view transversely through a beam of the liquid applicator, with the liquid distribution wall fastened to the beam.

The liquid applicator according to FIG. 1 comprises an angular beam 1 whose overflow weir, spanning 90°, is directed upward. A leg that runs diagonally upward with respect to overflow weir 2 forms dam 3 whose guide surface 4 abuts downstream from overflow weir 2, which is rounded here. The liquid film to be applied to the web of goods flows, uniformly distributed, over this guide surface; said film flowing onto the web of goods 7 guided over a roller 6 after leaving lower edge 5 of the guide surface 4.

On a side opposite to dam 3 of beam 1, a massive body 8, providing a liquid distribution wall, is fastened in a liquid-tight manner, said body defining a liquid supply chamber 9 in the area associated with the overflow weir 2. This liquid supply chamber 9 according to FIG. 1 is firstly delimited by dam 3 and secondly by opposite dam 10, spaced at a distance above dam 3 and running parallel thereto. The liquid supply chamber 9 thus formed is machined into body 8 to provide a plurality of partial or sub liquid supply chambers 9' as shown in FIG. 4. The upper end of liquid supply chamber 9 together with body 8 projects beyond the plane of guide surface 4 for a better effect on the liquid film as the film flows away. Liquid inflow area 11 is located at the end of liquid supply chamber 9 opposite overflow weir 2. It includes a plurality of bores 12 extending transversely through body 8, said bores then having liquid inflow openings 13 at the lower end of the liquid supply chamber 9. These openings are expanded funnelwise.

At the opposite, upper ends of bores 12, a liquid distribution device 14 is located. This device is described in DE 40 26 198 A1 and corresponding U.S. Pat. No. 5,243,841, the disclosure of which is incorporated herein by reference. In this device, the inflowing liquid from a feed line 15 is divided stepwise into the individual bores 12. There can also be only two steps, so that only two bores 12 are supplied with liquid from a feed line 15, equipped with a flexible hose for example, not shown, through two branch lines of the same length and extending to the right and left. Liquid distribution device 14 is sealed in a liquid-tight manner by a lid 16 permanently connected with body 8 by screws 17.

Figure 2:
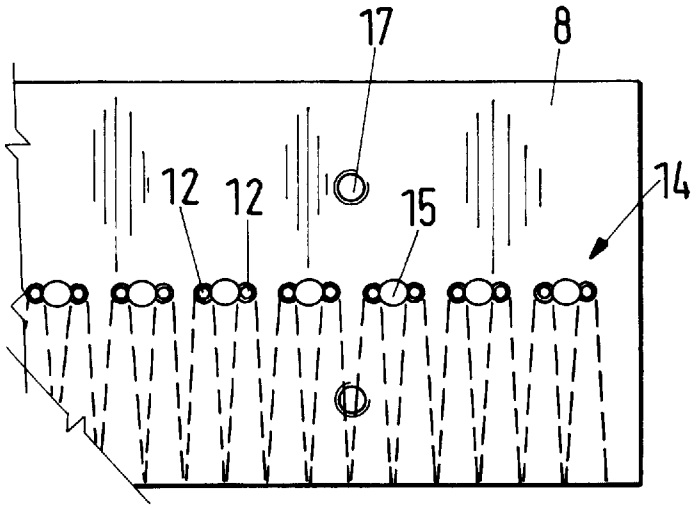
FIG. 2 is a partial plan view of the liquid distribution wall taken along line II—II of FIG. 1.
Figure 3:
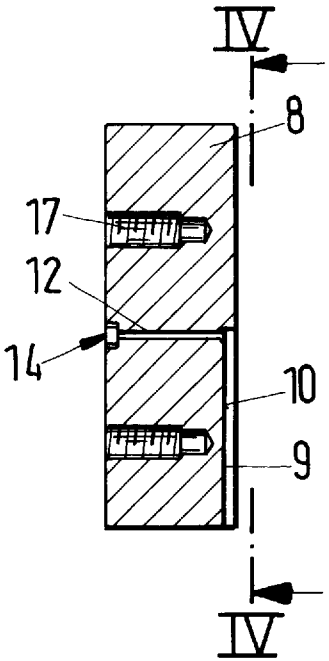
FIG. 3 is a cross sectional view through the liquid distribution wall, with the support surface provided at the bottom to produce the liquid supply chambers.

The configuration of each partial liquid supply chamber 9' is evident from FIGS. 2 and 4. First of all, it should be noted that each liquid supply chamber 9' extends in a manner that does not remain constant over the entire working width of the device. In order to be able to select the desired working width of the applicator, liquid supply chamber 9 is not interrupted in the immediate vicinity of overflow weir 2, but immediately before that point (as viewed in the flow direction of the liquid). From this point, limiting walls 19 extend up to liquid infeed area 11, said walls separating adjacent partial liquid supply chambers 9' from one another.

It has already been described how dam 3 and opposite dam 10 run parallel to one another. In order to obtain a partial supply chamber 9' that expands conically toward overflow weir 2, flanks 18 of limiting walls 19 are directed diagonally outward from liquid inflow opening 12. This produces a partial liquid supply chamber 9' that expands and that has a conic section, although dam 3 and opposite dam 10 run parallel to one another.

Figure 4A:
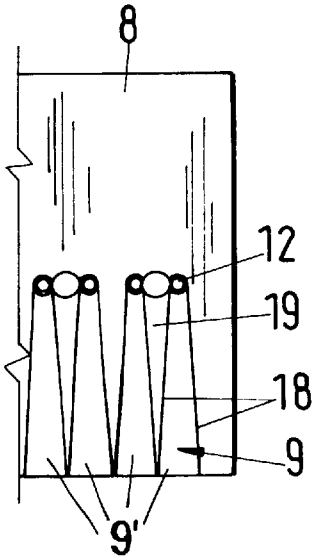
FIGS. 4A and 4B show partial plan views of the bottom of the liquid distribution wall taken along line IV—IV in FIG. 3.
Figure 4B:
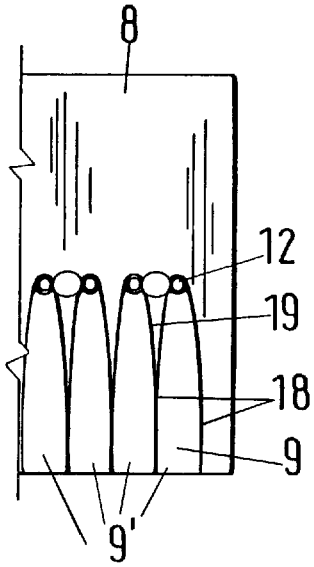

It is evident from FIGS. 4A and 4B that a partial liquid supply chamber 9' that expands with a conic section extends toward the overflow weir 2 from each of the many liquid inflow openings 12. The adjacent partial liquid supply chambers 9', separated from one another by enclosing limiting wall 19, merge with one another, immediately in front of the overflow weir at the latest to form the outlet of the liquid supply chamber 9. It is even better to make the limiting walls 19 slightly longer than the plane of guide surface 4 of the edge of overflow weir 2. This results in a clear separation of the individual liquid streams in the liquid supply chambers 9'. Flanks 18 of adjacent liquid supply chambers 9' meet at acute angles in the vicinity of the overflow weir and end at the edge of the overflow weir. Flanks 18, as shown, can be rectilinear (FIG. 4A) or even curved parabolically FIG. 4B.

What is claimed is:

1. A device for applying a liquid film of considerable width, exhibiting laminar flow and uniformly thin over the working width of the device, to a continuously advancing web of goods, said device comprising a liquid supply chamber which is delimited on one side by a first dam directed diagonally upward from the horizontal and extending over the working width, said dam having an overflow weir in the flow direction of the liquid as well as a guiding surface abutting the overflow weir, from the lower edge of which surface a film of liquid overflows onto the web of goods, and which also is delimited by an opposite second dam at a distance from the first dam, with the liquid supply chamber defining a space having a liquid inflow area at the end opposite the overflow weir, said area being formed by a plurality of liquid inflow openings connected with at least one liquid feed line supplied with liquid, and said liquid supply chamber extending over the full working width of the entire device in the vicinity of the overflow weir being divided by at least one limiting wall in the space of liquid supply chamber, said at least one limiting wall extending from the overflow weir to the liquid inflow area to provide a plurality of partial liquid supply chambers extending across the full wording width.

2. A device according to claim 1, wherein a plurality of said limiting walls is disposed in the liquid supply chamber, so that the width of the liquid supply chamber is subdivided several times over the width of the overflow weir to provide the plurality of partial liquid supply chambers.

3. A device according to claim 2, wherein only one liquid inflow opening is associated with each of the partial liquid supply chambers.

4. A device according to claim 2, wherein the limiting walls of the partial liquid supply chambers are part of a body member providing the opposite second dam, so that the partial liquid supply chambers are formed in said body member.

5. A device according to claim 4, wherein an end of the opposite second dam adjacent to the overflow weir extends above a plane of the guide surface.

6. A device according to claim 1, wherein only one liquid inflow opening is associated with each of the partial liquid supply chambers.

7. A device according to claim 1, wherein the liquid supply chamber expands with diverging walls toward the overflow weir, the first dam and the opposite second dam run parallel to one another and a taper of each partial liquid supply chamber is produced by an additional limiting wall that partially fill the liquid supply chamber, flanks of said walls tapering from the respective liquid inflow opening toward the overflow weir.

8. A device according to claim 7, wherein each delimited partial liquid supply chamber extends in an liquid inflow area toward the overflow weir.

9. A device according to claim 8, wherein adjacent partial liquid supply chambers separated from one another by a limiting wall merge with one another, directly before the overflow weir at the latest.

10. A device according to claim 9, wherein flanks of adjacent partial liquid supply chambers join at acute angles in the immediate vicinity of the overflow weir.

11. A device according to claim 10, wherein ends of flanks of the partial liquid supply chambers terminate beyond an edge of the overflow weir in the vicinity of the edge.

12. A device according to claim 11, wherein the flanks of the partial liquid supply chambers diverge rectilinearly starting at a liquid inflow opening.

13. A device according to claim 11, wherein the flanks of the partial liquid supply chambers diverge in a parabolic shape, starting at a liquid inflow opening.

14. A device according to claim 7, wherein an end of the opposite second dam adjacent to the overflow weir extends above a plane of the guide surface.

* * * * *